US005712048A

United States Patent [19]

Buresch et al.

[11] Patent Number: 5,712,048

[45] Date of Patent: Jan. 27, 1998

[54] PARTIALLY HOT-TIN-PLATED STRIP AND A METHOD AND APPARATUS FOR ITS MANUFACTURE

[75] Inventors: Isabell Buresch, Illertissen; Traugott Schneider, Ulm; Hermann Sturm, Bellenberg, all of Germany

[73] Assignee: Wieland-Werke AG, Ulm, Germany

[21] Appl. No.: 620,505

[22] Filed: Mar. 22, 1996

[30] Foreign Application Priority Data

Mar. 30, 1995 [DE] Germany ..... 195 11 656.9

[51] Int. Cl.[6] ..... B32B 15/00; B32B 15/01; B32B 3/00

[52] U.S. Cl. ..... 428/615; 428/646; 428/647; 428/648; 428/687; 428/195; 428/209

[58] Field of Search ..... 428/646, 647, 428/648, 615, 687, 195, 209

[56] References Cited

U.S. PATENT DOCUMENTS

| | | | |
|---|---|---|---|
| 2,274,963 | 3/1942 | Hopper | 428/646 |
| 2,394,545 | 2/1946 | Grupe | 428/648 |
| 3,857,684 | 12/1974 | Kubu | 428/646 |
| 4,376,154 | 3/1983 | Nakatsugawa | 428/647 |
| 4,529,628 | 7/1985 | Haour et al. | 427/317 |
| 5,429,882 | 7/1995 | Carey, II et al. | 428/647 |

FOREIGN PATENT DOCUMENTS

| | | |
|---|---|---|
| 0 450 069 | 10/1991 | European Pat. Off. . |
| 278 819 | 5/1990 | Germany . |
| 61-15955 | 1/1986 | Japan . |
| 61-235550 | 10/1986 | Japan . |

*Primary Examiner*—Patrick Ryan
*Assistant Examiner*—Cathy F. Lam
*Attorney, Agent, or Firm*—Flynn, Thiel, Boutell & Tanis, P.C.

[57] ABSTRACT

A ship that is partially hot-tin-plated with at least one metallic coating track extending in longitudinal direction on or both of its upper and lower surfaces and/or along one or both side edges. An intermetallic phase exists between the ship material and the coated track. In order to satisfy the many uses for partially tin-plated ships in the electronics and electrotechnical fields and for the manufacture of semiconductor elements, the track, viewed in longitudinal direction, is interrupted according to the invention at regular and/or irregular spacings ($A_1$, $A_2$, $A_3$ . . . ).

16 Claims, 5 Drawing Sheets

PARTIALLY HOT-TIN-PLATED STRIP AND A METHOD AND APPARATUS FOR ITS MANUFACTURE

FIELD OF THE INVENTION

The invention relates to a partially hot-tin-plated strip of a coatable material and more particularly to a method and apparatus for its manufacture.

BACKGROUND OF THE INVENTION

The need for high-grade tin-plated strips is increasing. Specific demands by the car industry, the semiconductor industry and other users dominate the market. Coatings of differently thick layers of a pure tin, tin alloys and so-called hard tin alloys are desired. Of a particular importance, in the last-mentioned alloys is the reduction of the insertion force.

A partial or rather one-sided tin-plating is desired for the following reasons:

a) Savings in raw materials (Sn), b) Coating of the functional areas, c) Property combination of in particular copper and copper alloy and Sn surfaces.

Partially tin-plated strips either on one side or both sides can be manufactured for example according to the method of U.S. Pat. No. 4 529 628.

Fluid metal is here partially applied through a nozzle onto either one or both sides of a strip. The thickness of the coating is controlled by the speed of the strip and the nozzle output. The thickness of the coating is thus uniform over the entire width of the strip. The coating is continuous over the length of the strip. It is only possible to apply one coating material per one band side. If several coating materials or rather different properties are demanded on one side of the strip, then several production steps one after the other are necessary. Also this method does not make it possible to coat the edges of the strip, which is demanded with respect to the soldering capability in the edge area or where contacting is to occur through the strip edge. Thus, this method is not very economical.

SUMMARY OF THE INVENTION

Therefore, the basic purpose of the invention is, in particular in accordance with the demand of the electronics industry, to enlarge the track coating on partially tin-plated strips.

The purpose is attained according to the invention that the track—viewed in longitudinal direction—being interrupted at regular and/or irregular spacings ($A_1$, $A_2$, $A_3$ . . . ). Spacings ($A_1$, $A_2$, $A_3$ . . . ) in the range of 1 to 20 mm are preferred.

If at least two tracks are provided, these are preferably interrupted in different ways. According to further preferred embodiments of the invention the tracks have varying coating thicknesses (D1/D2), or the tracks consist of different coating materials.

In the case of varying coating thicknesses of the tracks or of the tin-plating on the front and back side, it is possible to combine the advantages of thin Sn-layers with, for example, low insertion and pulling forces with the advantages of thick Sn-layers with, for example, a good solderability (especially for plug connectors).

It is also possible to combine harder coating materials, for example in the contact zone, with softer coating materials, for example in the crimp or soldering area.

Copper, copper alloy, iron or iron alloy can preferably be used as the strip material; pure tin, tin alloys and zinc are preferably available as coating materials.

The invention relates furthermore to a method and apparatus for the manufacture of the partially hot-tin-plated strip. The method is based on the moving strip being provided with flux and being heated and molten metal being applied from at least one storage chamber through at least one opening onto the heated strip and excess molten metal being wiped off. The method is characterized by the supply of molten metal from the opening being opened and closed in a controlled manner.

When manufacturing a strip having at least two tracks, it is advisable that the supply of the molten metal is differently controlled for the individual tracks.

When manufacturing a strip having at least two tracks of differing thicknesses, the invention provides for the molten metal on the strips to be differently wiped off.

According to the invention it is furthermore possible to use different coating materials on one and the same strip.

The apparatus for carrying out the method of the invention has a simple design. It has an decoiler, a flux distributor, a heating chamber, a storage chamber provided with at least one opening for the molten metal, a wiper for the molten metal, and an coiler. The storage chamber is according to the invention arranged in an exchangeable insert for the heating chamber having an essentially U-shaped cross section, and tools for controlling the supply of the molten metal are provided.

To manufacture, for example, a strip having at least two approximately centrally arranged strips, the storage chamber feeds at least two side-by-side lying openings.

To manufacture a strip with coated edge tracks, the insert has according to the invention two storage chambers opened laterally with respect to the sides of the heating chamber. If in addition also the edge strips of the opposite side are to be coated, the storage chambers are then connected to grooves in the heating chamber which extend around the band edges. Thus, the ship edge is additionally coated.

In contrast to electro-plating, the invention achieves structures in which the coating tracks are distinguished by a high adhesion.

Partially tin-plated strips are used in the electronics and electrotechnical field. They are, for example, used for the manufacture of plug connectors for the car industry, the telecommunications industry and others. Partially coated strips are also used in the manufacture of semiconductor elements like QFP's (quad flat packages), SOT's (small outline transistors), IC's (integrated circuits) and others. Of importance is here the combination of the clean strip surface with a well solderable tin-plated surface.

BRIEF DESCRIPTION OF THE DRAWINGS

The invention will be discussed in greater detail in connection with the following exemplary embodiments, in which.

DETAILED DESCRIPTION

Figure 1:
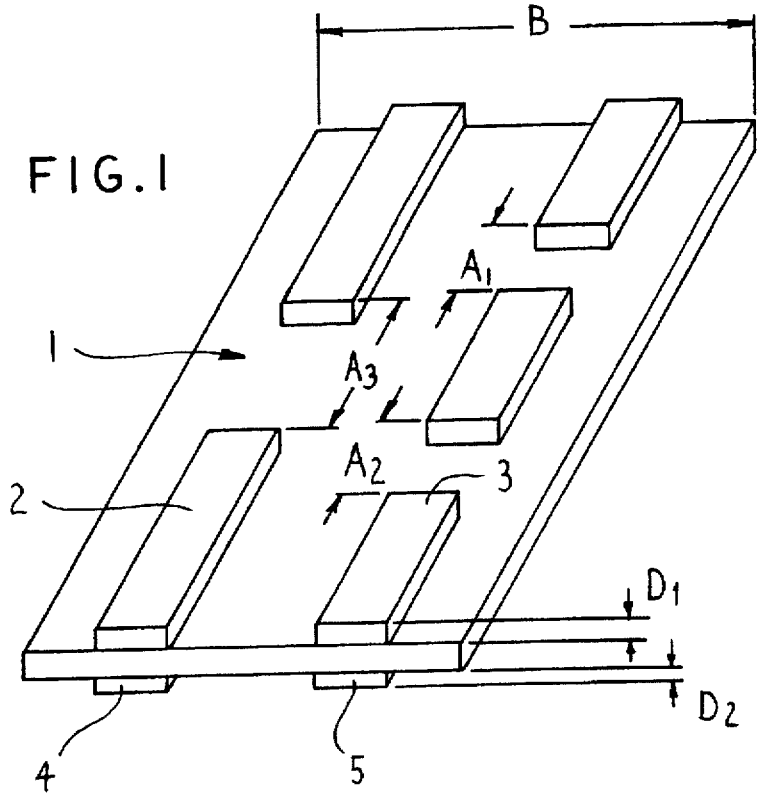
FIGS. 1 and 2 each illustrate schematically the arrangement of interrupted coating tracks on a strip.
Figure 2:
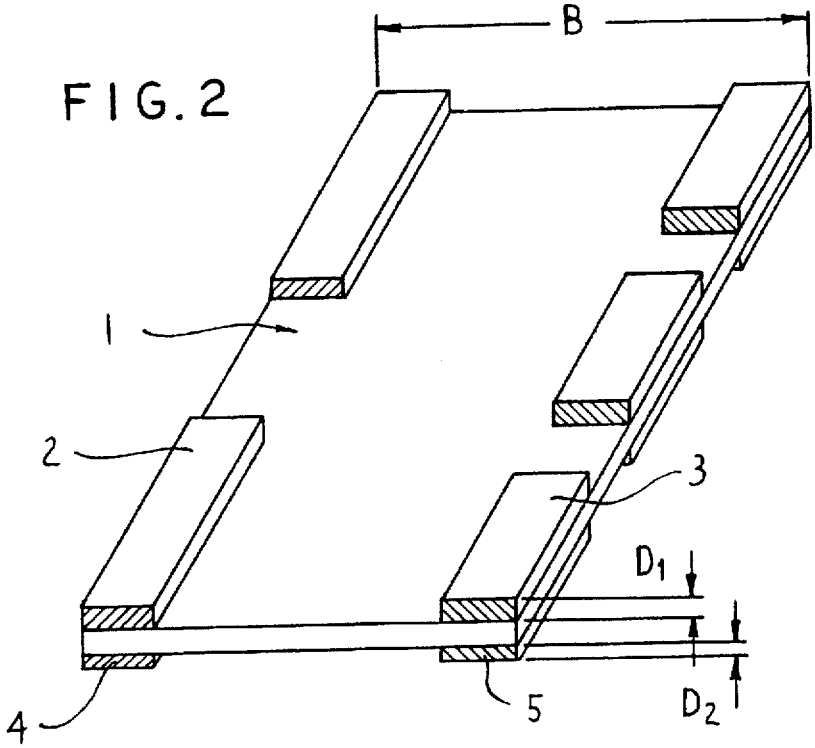

The strips according to FIGS. 1 or 2 each have four coating tracks 2, 3, 4 and 5. These are, according to FIG. 1, arranged approximately in the center of the strip, according to FIG. 2 along the edges of the strip. The tracks 2, 3 on the upper side of the strip in both of FIGS. 1 and 2 have a coating thickness D1; the tracks 4, 5 on the underside of the strip a coating thickness D2. FIG. 2 furthermore indicates that the tracks 2, 4 consist of a different coating material than the tracks 3, 5. Only from the two FIGS. 1 and 2 one can see the many possibilities of the tin-plating of the strip with tracks 2, 3, 4, 5 interrupted by varying spacings ($A_1$, $A_2$, $A_3$ . . . ).

Figure 3:
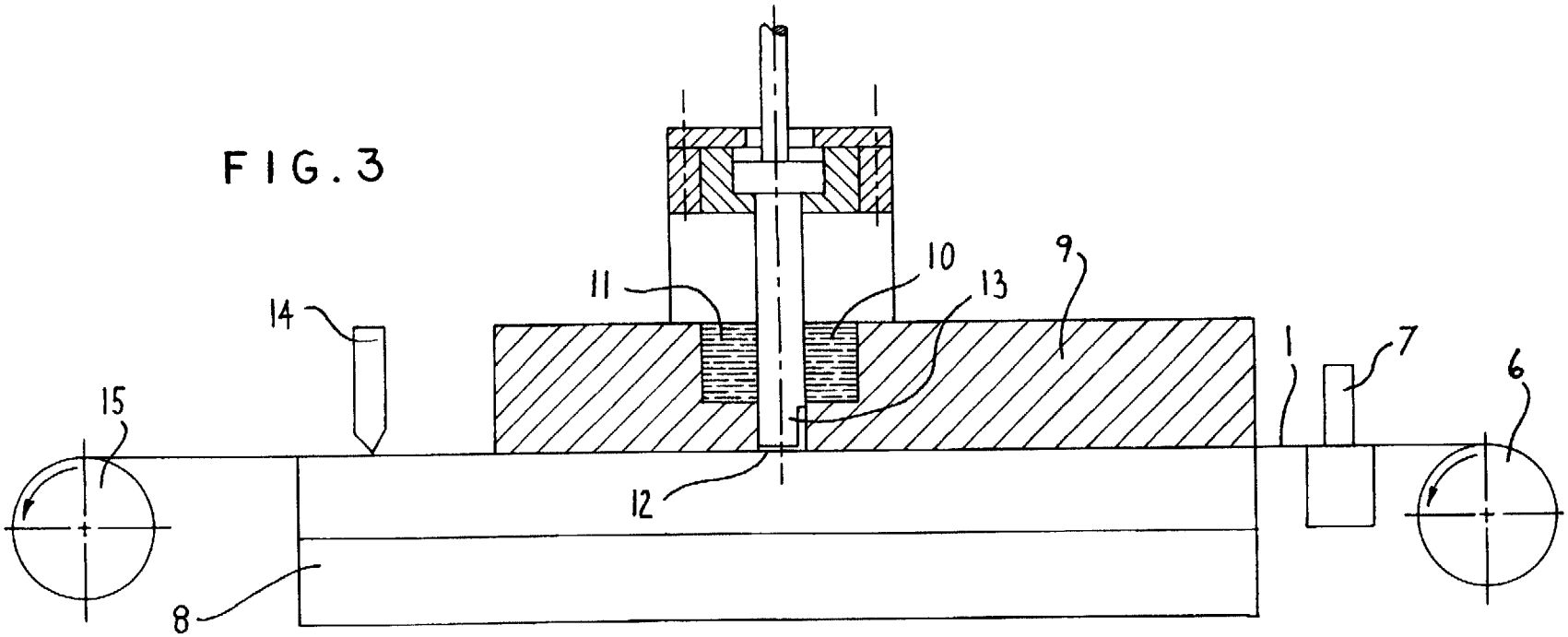
FIG. 3 illustrates schematically the sequence of operational events; and FIGS. *4a*, *4b*, *4c*, *5a*, *5b*, *5c*, *6a*, *6b* and *6c* illustrate schematically the design of various storage chambers.

FIG. 3 illustrates the operating sequence of the invention:

The strip 1 unwinding from an decoiler 6 runs through a flux distributor 7 and moves in order to be heated up, into a heating chamber 8, into which a melt distributor 9 is integrated, in which distributor a storage chamber 10 is arranged. The molten metal 11 provided in the storage chamber 10 is thus at the same time maintained at a specified and controlled temperature. The insert 9 rests yieldingly on the strip 1. The molten metal 11 provided for the coating can reach the strip 1 through an opening 12. Tools for controlling the melt supply (plug control or equal) are indicated by the reference numeral 13. The coating thickness which will define the tracks 2, 3, 4, 5 to be applied can be varied through the subsequent wipes 14 for the molten metal 11 and/or through a more or less strong bearing of the insert 9 on the strip 1. The tin-plated strip 1 is finally rolled up on a roll-up coiler 15.

FIGS. 4*a* to 6*c* schematically illustrate the design of various storage chambers 10 (cross-sectional view/top view) in parts "a" and "b" thereof and the arrangement of the tracks 2, 3, 4, 5 resulting therefrom on the strip 1 in part "c" thereof.

Figure 4A:
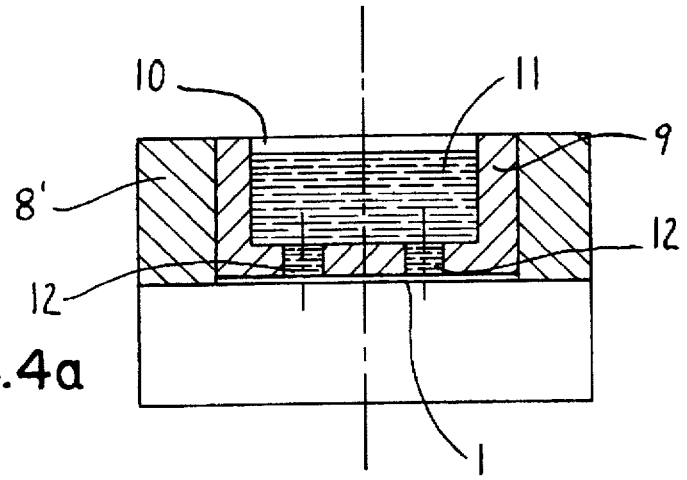
Figure 4B:
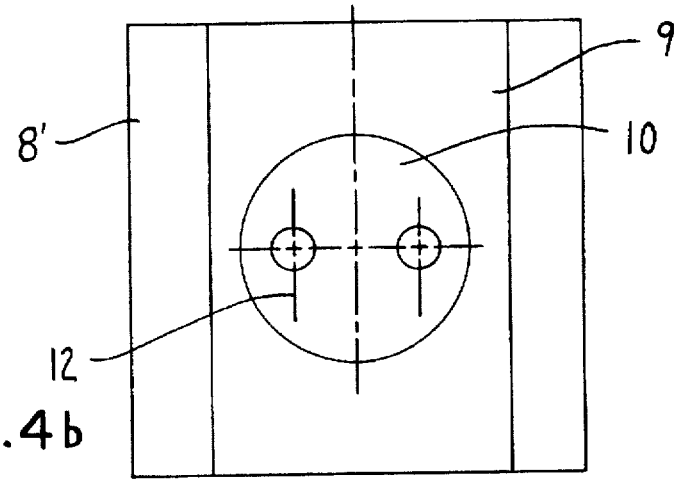
Figure 4C:
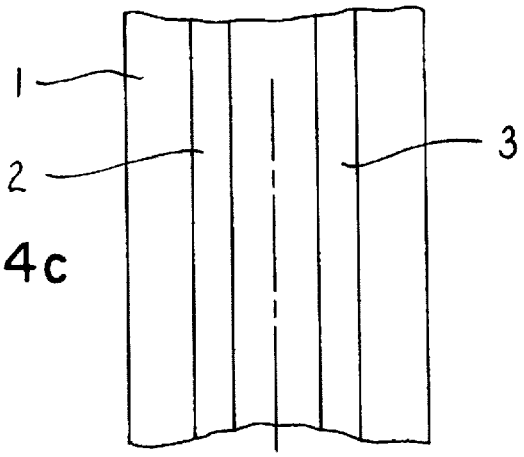

According to FIG. 4*a*, one storage chamber 10 feeds, for example, two side-by-side lying openings 12.

Figure 5A:
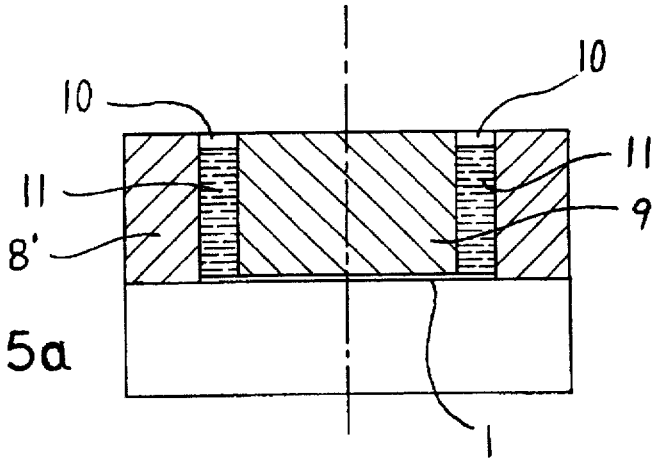
Figure 5B:
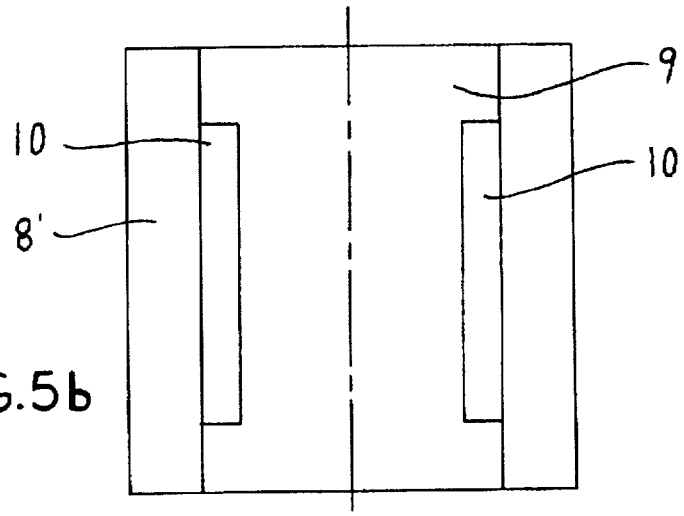
Figure 5C:
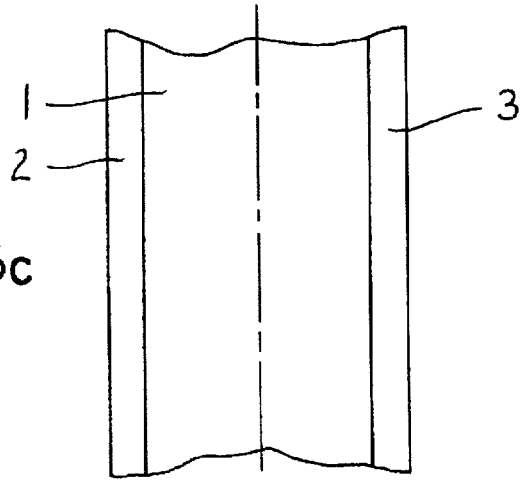
Figure 6A:
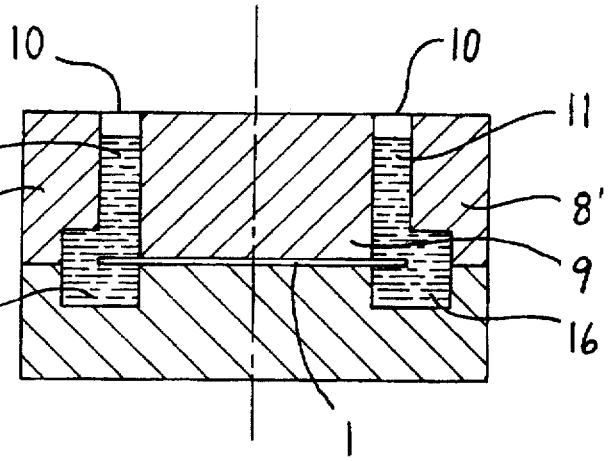
Figure 6B:
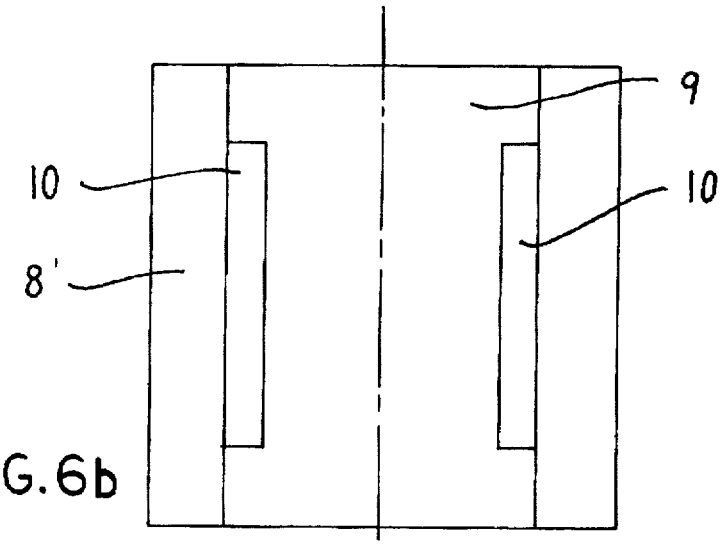
Figure 6C:
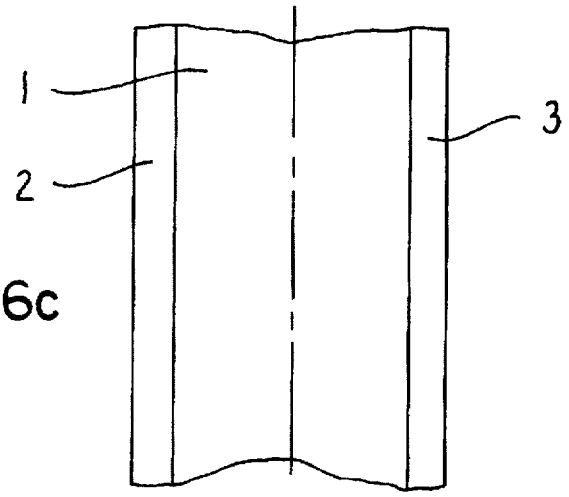

The insert 9 has according to FIG. 5*a* two storage chambers 10 laterally open toward the sides 8' of the heating chamber 8 so that the tracks 2, 3, 4, 5 are formed on the edges of the strip.

Should during the same operating sequence the underside of the strip also be provided with tracks, then these storage chambers 10 are connected to grooves 16 (FIG. 6*a*) in the heating chamber 8 extending around the edges of the strip (means for controlling the molten supply are here not illustrated in detail).

The heating chamber 8, which is essentially U-shaped in cross section, can, for example, consist of a base plate provided with heating cartridges, onto which base plate are screwed a graphite plate and side legs 8' also of graphite. The material for the insert 9 can also be graphite.

Strips with the following dimensions can be tin-plated: Thickness: 0.05 to 1.5 mm, Width: 5 to 200 mm.

Tin-plating temperature: 50° to 400° C.

Tin-plating speed: 5 to 100 m/min.

It is possible to achieve coating thicknesses of 0.2 to 25 μm.

Because of the method, the partially coated strips have in this manner an intermetallic phase between the coating and the base material, which increases the adhesion of the coating so that a peeling off of the coating during the occurrences of bending does not occur, not even after heat treatments.

The embodiments of the invention in which an exclusive property or privilege is claimed are defined as follows:

1. In a strip partially hot-tin-plated with a coatable material, the strip having on at least one of a top and bottom surface thereof at least one metallic coating track thereon with a smaller width than the strip width, the metallic coating track extending in longitudinal direction, wherein between the strip material and the metallic coating track there exists an intermetallic phase, and wherein the longitudinal extent of the metallic coating track includes at least one spacing which is free of metallic coating.

2. The strip according to claim 1, wherein the spacing is in the range of 1 to 20 mm.

3. The strip according to claim 1, wherein at least two tracks are provided on the strip, and wherein each of the metallic coating tracks includes at least one spacing which is free of metallic coating.

4. The strip according to claim 1, wherein at least two tracks are provided on the strip, and wherein each of the segments of the metallic coating forming one metallic coating track has the same coating thickness and different tracks have different thicknesses.

5. The strip according to claim 1, wherein at least two tracks are provided on the strip, and wherein each of the metallic coating tracks consist of a different coating material.

6. The strip according to claim 1, wherein the strip consists of copper, a copper alloy, iron or an iron alloy.

7. The strip according to claim 6, wherein the metallic coating tracks consist of pure tin, a tin alloy or zinc.

8. The strip according to claim 1, wherein the metallic coating tracks consist of pure tin, a tin alloy or zinc.

9. The strip according to claim 1, wherein the longitudinal extent of the track includes plural spacings which are each free of metallic coating.

10. The strip according to claim 9, wherein the spacings are each in the range of 1 to 20 mm.

11. The strip according to claim 1, wherein both of the top and bottom surfaces of the strip have at least one metallic coating track thereon, each track including at least one spacing which is free of metallic coating.

12. The strip according to claim 11, wherein the metallic coating tracks are both oriented at a common edge of the strip.

13. The strip according to claim 12, wherein the metallic coating tracks are oriented on direct opposite sides of the strip.

14. The strip according to claim 11, wherein the metallic coating tracks are oriented on direct opposite sides of the strip.

15. The strip according to claim 11, wherein each of the segments of metallic coating forming one metallic coating track has the same thickness.

16. The strip according to claim 11, wherein the metallic coating tracks each have a different thickness.

* * * * *